US007306103B2

(12) United States Patent
Dustin et al.

(10) Patent No.: US 7,306,103 B2
(45) Date of Patent: Dec. 11, 2007

(54) FINGER OPERABLE CONTAINER

(75) Inventors: David Dustin, Feeding Hills, MA (US); Robert L. Pierpont, Meriden, CT (US); Andrew T. Butkus, Naugatuck, CT (US); Ralph L. Hitchcock, Winstead, CT (US)

(73) Assignee: Rexam Cosmetic Packaging, Inc., Torrington, CT (US)

( * ) Notice: Subject to any disclaimer, the term of this patent is extended or adjusted under 35 U.S.C. 154(b) by 401 days.

(21) Appl. No.: 10/931,448

(22) Filed: Sep. 1, 2004

(65) Prior Publication Data

US 2006/0042994 A1 Mar. 2, 2006

(51) Int. Cl.
*B65D 71/00* (2006.01)

(52) U.S. Cl. ..... 206/581; 206/823; 220/345.1

(58) Field of Classification Search ..... 206/581, 206/823, 37, 39, 39.6, 38, 560, 564; 220/345.1, 220/345.2, 345.3
See application file for complete search history.

(56) References Cited

U.S. PATENT DOCUMENTS 1,166,881 A * 1/1916 Anderson ..... 30/113
2,534,100 A 12/1950 Baumgartner
4,388,935 A 6/1983 Napolitane
4,526,273 A 7/1985 Tsuji et al.
4,898,195 A 2/1990 Sussman
5,163,457 A 11/1992 Lombardi, Jr.
D391,016 S * 2/1998 Marusiak ..... D27/195
5,715,602 A * 2/1998 Hage ..... 30/113
5,947,280 A * 9/1999 Jimenez ..... 206/238
6,073,634 A 6/2000 Gueret
D433,191 S 10/2000 Adachi et al.
6,164,286 A 12/2000 Schad
D436,693 S 1/2001 Thorpe et al.
6,216,346 B1 4/2001 Wechsler
6,540,083 B2 4/2003 Shih
6,694,987 B2 2/2004 Thiebaut

* cited by examiner

*Primary Examiner*—Shian T. Luong
(74) *Attorney, Agent, or Firm*—Alston & Bird LLP

(57) ABSTRACT

A finger operable container is provided for use with cream, paste or cake-like products, such as cosmetics. The container comprises an assembly including a housing and at least one cooperating slide member received by the housing. At least one receptacle is provided in the assembly for receiving the product, and a pair of finger openings is formed in the assembly through which two fingers of the same hand can be inserted. The finger openings are configured and arranged to allow the finger movements of a single hand to move the assembly between a closed storage position in which the receptacle is covered and an open position in which the receptacle is exposed to permit application of the product.

14 Claims, 6 Drawing Sheets

FINGER OPERABLE CONTAINER

BACKGROUND OF THE INVENTION

The invention relates to a container, and more particularly to a container for products, such as cosmetics, in the form of a cream, paste or cake.

Various kinds of cosmetic preparations are sold in small, transportable containers that will fit in a purse or handbag and that provides for storage and application of the cosmetic preparation. A common type of container for cream, paste or cake-like cosmetic products, such as makeup, blush, eye shadow and the like, is a compact which consists of a pair of clam shell like plates hingedly connected at a rear edge so that the cosmetic preparation can be protectively stored in the compact with the plates in the closed position, and the compact can be opened for application of the cosmetic.

The cosmetic industry continues to seek new and innovative packaging for presenting various cosmetic products to the consumer as an alternative to standard packaging such as conventional compacts of the type just described.

The present invention addresses this need by providing a unique package design for cream, paste or cake-like products, such as cosmetics. The present invention provides a novel, easy to use container suitable for a wide variety of products. Although the container is illustrated and described herein in connection with its use as a container for cosmetics, it is to be understood that the container is not limited to cosmetic products and various other kinds of product could be used with the container.

A particularly advantageous feature of the present invention is its ease of use. Its design allows for the container to be opened and closed using two fingers of the same hand, leaving the other hand free for application of the cosmetic or other product.

BRIEF SUMMARY OF THE INVENTION

In accordance with one broad aspect of the present invention, a finger operable container is provided for use with cream, paste or cake-like products, such as cosmetics. The container comprises an assembly including a housing and at least one cooperating slide member received by the housing. At least one receptacle is provided in the assembly for receiving the product, and a pair of finger openings is formed in the assembly through which two fingers of the same hand can be inserted. The finger openings are configured and arranged to allow the finger movements of a single hand to move the assembly between a closed storage position in which the receptacle is covered and an open position in which the receptacle is exposed to permit application of the product.

The design of the present invention is versatile, providing various options for presenting the product. In one embodiment, the assembly includes a housing with a single cooperating slide member. One of the finger openings is located in this slide member and the other finger opening is located in the housing. The receptacle for the product may be located in the housing, with a central access opening in the housing providing access to the receptacle. In this embodiment, the slide member is moveable between a closed position protectively covering the receptacle and an open position in which the receptacle is uncovered. If desired, the slide member may be made of a transparent material so that when the slide member is in the closed position, the color shade of the product in the receptacle can be seen by the user.

In another embodiment, the assembly includes a housing with first and second cooperating slide members that extend into the housing from opposite sides. The finger openings are located in the first and second slide members. In this embodiment, the receptacle for the product may be located in the housing, with a central access opening in the housing providing access to the receptacle. The first and second slide members can be moved from a closed storage position where they cooperate to protectively cover the receptacle to an open position in which the receptacle is uncovered.

In yet another embodiment where the assembly includes first and second slide members, a product receptacle is provided in each of the slide members. When the slide members are in the closed position, the receptacles are concealed within the housing and when the slide members are moved outwardly to the open position, the receptacles are exposed. Thus, this embodiment provides for the storage and application of two different cosmetic products, e.g. of different color shades. The container may also be provided with a mirror. For example, the mirror may be mounted to the housing between the first and second finger openings.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
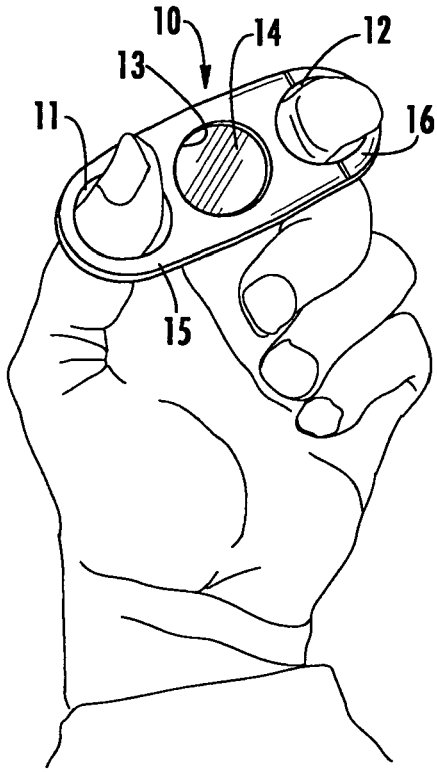
FIG. 1 is a perspective view showing a container in accordance with a first embodiment of the present invention.

Referring now in more detail to the drawings, FIG. 1 illustrates a container 10 held by the thumb and forefinger of a person's left hand. The term "finger" is used herein with its broad ordinary meaning to refer to any of the five terminating members of the hand, including the thumb. Obviously, the container could be used and operated with other fingers, but is most conveniently held and used by the thumb and forefinger. In the embodiment shown, the container includes a finger opening 11 through which the thumb is inserted and a finger opening 12 through which the forefinger is inserted. The finger openings are of generally circular configuration and of substantially the same diameter. Located between the finger openings 11, 12 is a circular access opening 13 which provides access to the cosmetic or other product housed within the container in an underlying receptacle or well. When the container is in the closed position shown in FIG. 1, a protective cover 14 overlies the cosmetic material.

Figure 2:
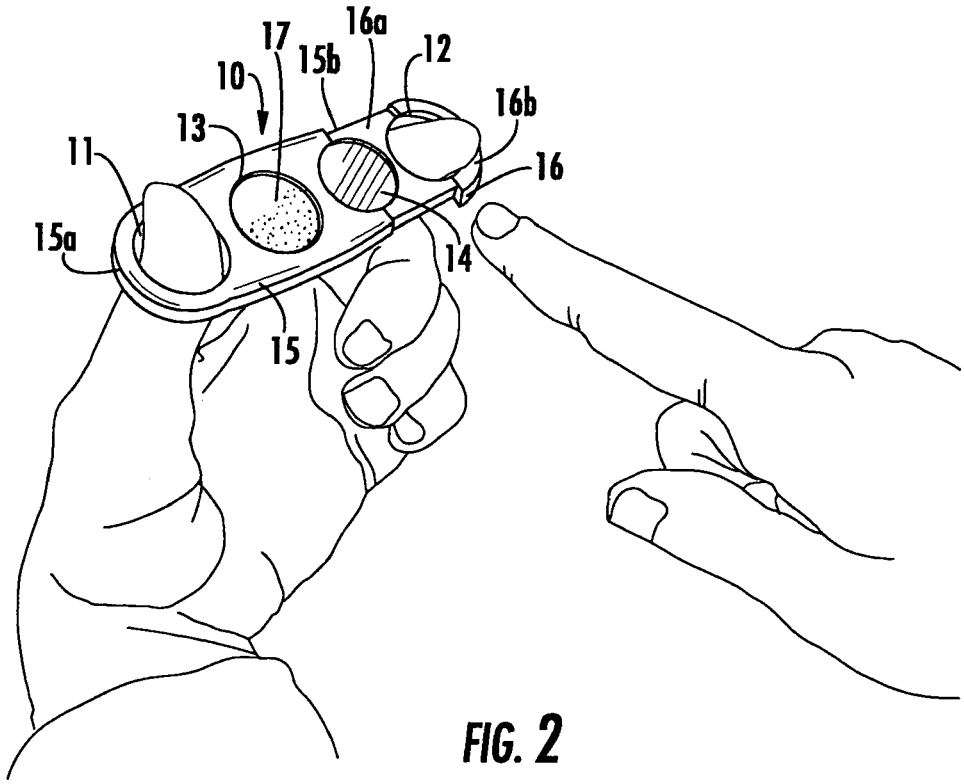
FIG. 2 is a perspective view illustrating how the container can be moved to the open position using the thumb and fore finger of the same hand, leaving the other hand free for application of the cosmetic.
Figure 3:
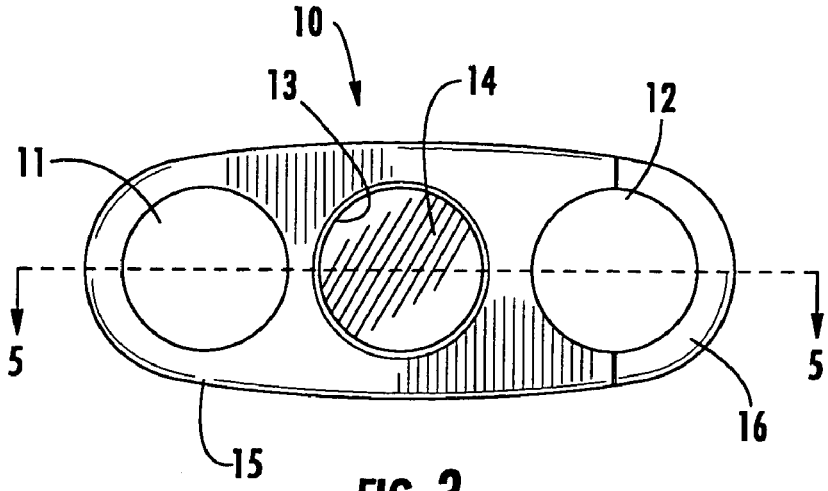
FIG. 3 is a top plan view of the container in the closed position.
Figure 4:
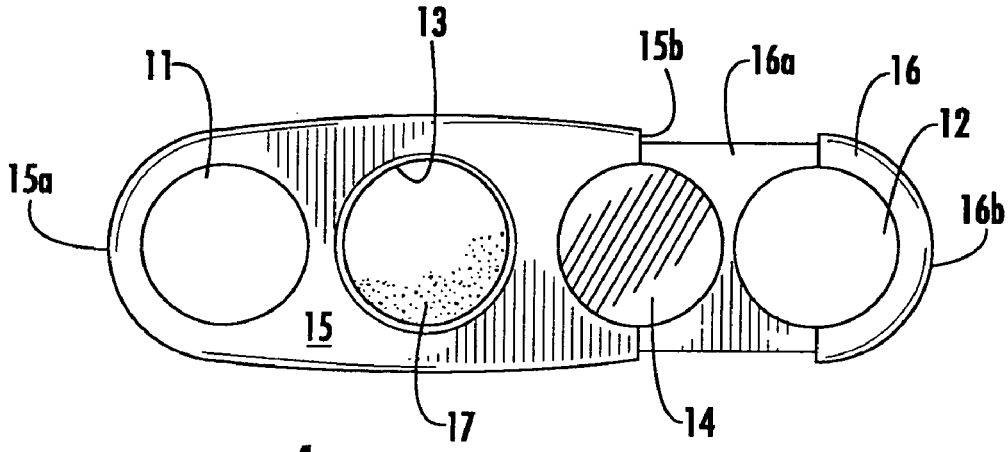
FIG. 4 is a top plan view of the container in the open position.

As seen in FIG. 2, the container has been moved from the closed position to an open position by extending the forefinger away from the thumb. As can be seen in FIG. 2, the container is comprised of an assembly including a housing 15 and a slide member 16. The housing 15, more particularly, has a first end portion 15*a* adjacent the finger opening 11 which is of a rounded configuration having a radius of curvature slightly larger than the radius of the finger opening 11 and with a common center axis. The housing has an interior cavity or passageway that terminates in an opening at the opposite end 15*b* of the housing into which the slide member 16 is slideably received. The slide member includes a relatively flat first portion 16*a* which is received within the interior passageway of the housing 15 and an externally disposed second portion 16*b* that remains outside the housing when the slide member 16 is in the closed position. As can be seen, this second portion 16*b* has a rounded end adjacent the finger opening 12 that conforms to the shape of housing 15. This rounded end has a radius of curvature slightly larger than the radius of the finger opening 12 and with a common center axis. At the end 15*b* of the housing where the slide member is received, the top and bottom walls of the housing 15 have an arcuate cut-out or recess corresponding to the radius of the finger opening 12 so that the finger opening is unobstructed when the slide member 16 is in the closed retracted position.

Figure 5:
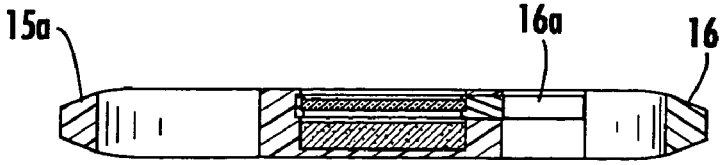
FIG. 5 is a cross sectional view of the container taken substantially along the line 5-5 of FIG. 3.

As best seen in FIG. 5, a receptacle 17 or well is formed in the housing 15 directly beneath the access opening 13. This receptacle can be filled with the cosmetic material. In the embodiment shown in FIGS. 1-5, the slide member 16 is formed from a single piece of material, such as injection molded plastic, which may be opaque or transparent. When the slide member 16 is opaque, a circular opening is provided in the flat first portion 16*a* of a size corresponding to the access opening and a circular insert is fitted into this opening to serve as the protective cover 14. The insert may be formed of a transparent material so that so that when the slide member is in the closed retracted position, the protective cover 14 is located between the access opening 13 in housing 15 and the underlying cosmetic material in the receptacle 17, protectively covering the cosmetic material while allowing the user to view the color shade of the cosmetic material. Alternatively, the insert that forms the protective cover 14 may be a mirror.

Figure 6:
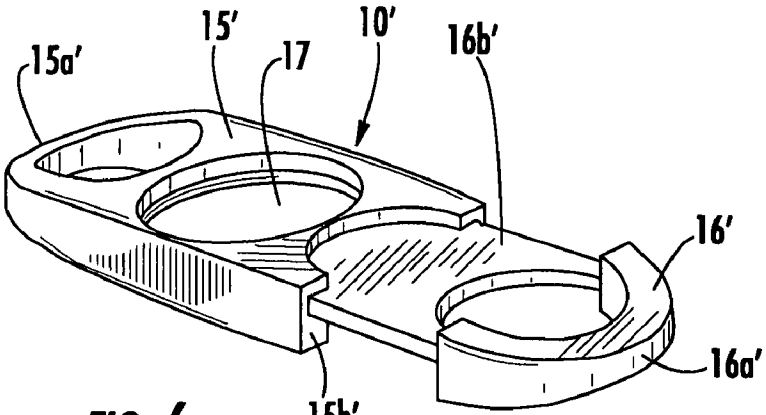
FIG. 6 is a perspective view in the open position of a container in accordance with a second embodiment of the present invention.

A modified form of the container is shown in FIG. 6 and indicated by the reference character 10'. To avoid repetitive description, elements that correspond to elements described in the previous embodiment will be identified with corresponding reference numbers, but with prime (') notation added. As in FIGS. 1 to 5, the container 10' includes a housing 15' and a slide member 16'. This embodiment differs over that of FIGS. 1-5 in that the slide member 16' can be made entirely of a transparent material, avoiding the need for an insert.

Figure 7:
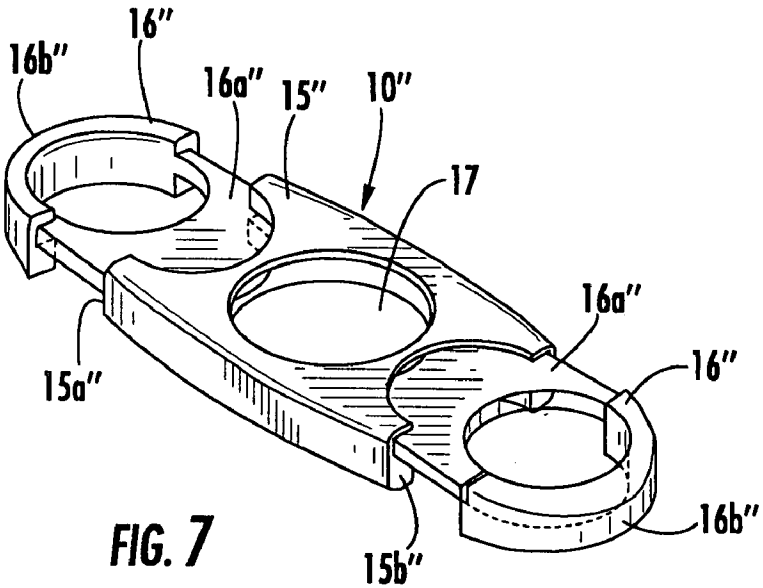
FIG. 7 is a perspective view of another embodiment of a container in accordance with the present invention.

Yet another embodiment of a container in accordance with the present invention is shown in FIG. 7. To avoid repetitive description, elements that correspond to elements described in the previous embodiments will be identified with corresponding reference numbers, but with double prime (") notation added. As with the previous embodiments, the container 10" includes a housing 15" with a hollow interior passageway. However, in this embodiment the passageway terminates in openings at both ends of the housing 15". Slide members 16" extend into the housing 15" at both the first end 15*a*" and the second end 15*b*" of the housing. When in the retracted closed position, the relatively flat first portion 16*a*" of the slide members meet one another to overlie and protectively cover the receptacle 17". However, when the slide members are moved to the extended open position as shown in FIG. 7, the receptacle 17" is uncovered to allow access to the cosmetic material.

Figure 8:
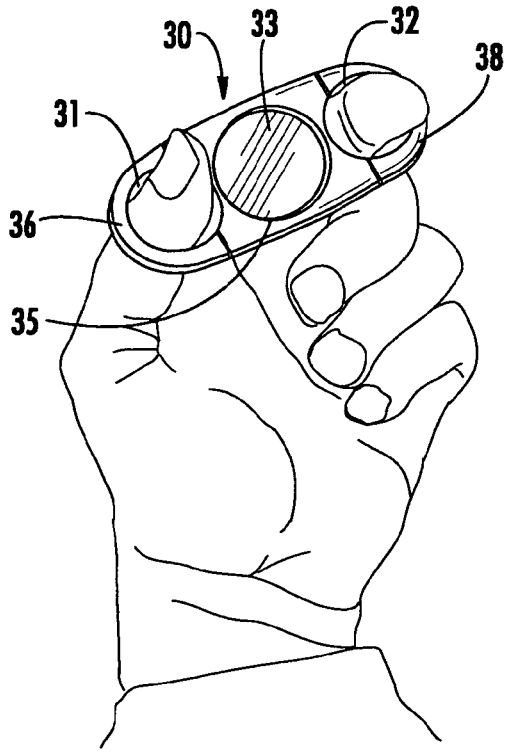
FIG. 8 is a perspective view similar to FIG. 1 but showing an alternate embodiment of the present invention.

In FIG. 8, a container 30 in accordance with a further embodiment of the invention is illustrated. As with the previous embodiments, the container has a finger opening 31 through which the thumb of one hand can be placed and a finger opening 32 for receiving the forefinger of the same hand. Between the two finger openings 31, 32 is mounted a circular mirror 33 to assist the user in applying the cosmetics.

Figure 9:
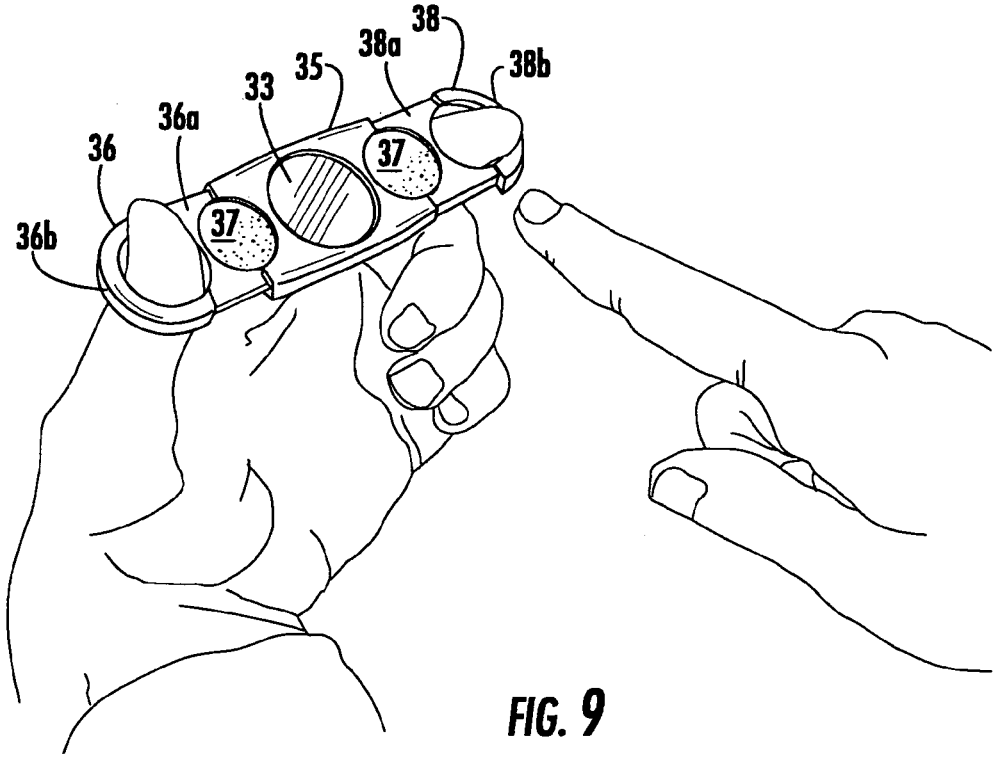
FIG. 9 is a perspective view showing the container of FIG. 8 in the open position.

As can be seen more clearly in FIG. 9, as well as in FIGS. 10-14, the container is comprised of an assembly including a housing 35 and cooperating slide members 36, 38. The housing has a hollow interior passageway terminating in openings at opposite ends of the housing. A first slide member 36 is slideably received by one of the openings, and a second slide member 38 is slideably received by the other opening. Each slide member 36, 38 includes a relatively flat first portion 36*a*, 38*a* that is received within the interior passageway of the housing 35 and an externally disposed second portion 36*b*, 38*b* located adjacent the respective opposite ends of the housing. The slide members 36, 38 can be moved from a closed retracted storage position as shown in FIG. 8 to an extended open position as shown in FIG. 9 for application of the cosmetic products.

Figure 10:
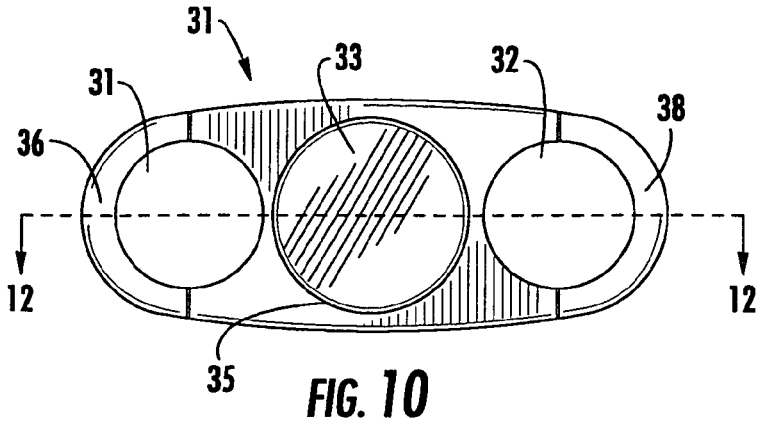
FIG. 10 is a top plan view of the container of FIG. 8.
Figure 11:
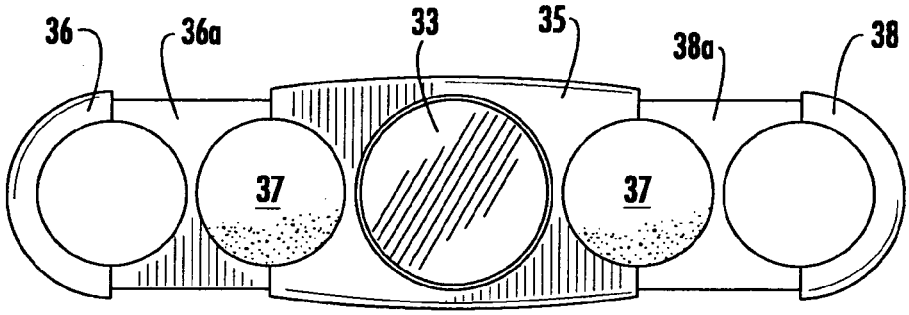
FIG. 11 is a top plan view of the container in the open position.
Figure 12:
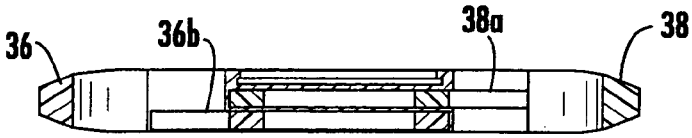
FIG. 12 is a cross sectional view of the container taken substantially along the line 12-12 of FIG. 10.
Figure 13:
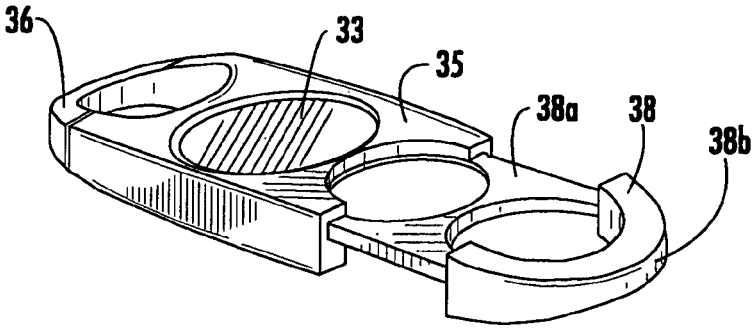
FIG. 13 is a perspective view of the container in a partially open position.

In the relatively flat first portion 36*a*, 38*a* of each slide member, there is provided a receptacle 37 for receiving the cosmetic product. The receptacle, more particularly, comprises a circular recess or well formed in the first portion 36*a*, 38*a*. When the container 30 is in the closed storage position as shown in FIGS. 8 and 10, the receptacles 37 are concealed within the housing 35 one above the other as shown in FIG. 12. When the slide members 36, 38 are moved to the extended open position as shown in FIGS. 9 and 11, the receptacles 37 are exposed and accessible for making application of the cosmetic.

Figure 14:
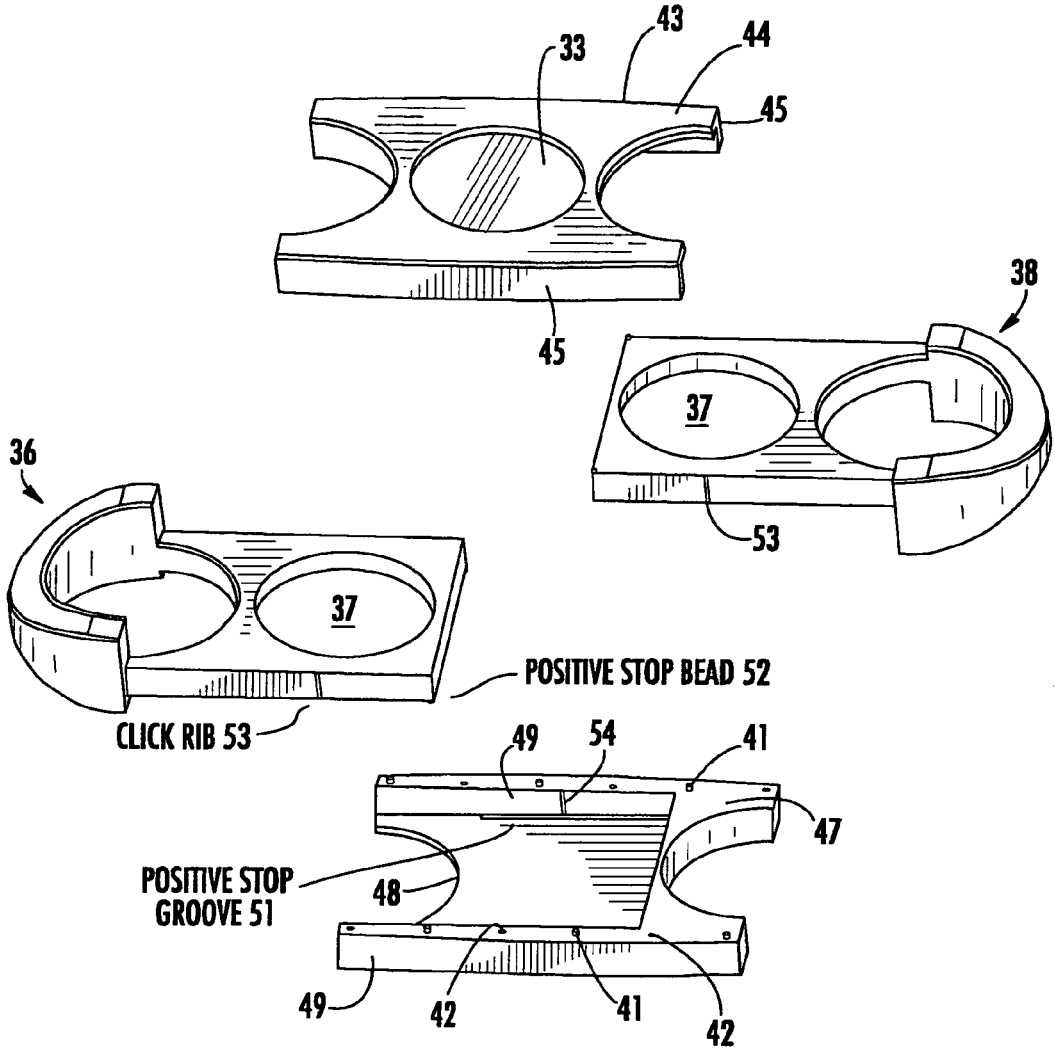
FIG. 14 is an exploded perspective view showing the components of the container.

As best seen in FIG. 14, the housing 35 is conveniently fabricated from two separate pieces of injection molded plastic that can be snap-fit together and held in assembled relation by respective integrally molded posts 41 and corresponding sockets 42 in the top and bottom pieces. The housing, more particularly, includes a top piece 43 that forms a top wall 44 and opposing sides 45, with the mirror 33 being mounted in a suitably shaped recess formed in the top wall 44. A bottom piece 47 defines a bottom wall 48 and opposing spaced apart sides 49 that collectively define the hollow interior passageway of the housing adapted for receiving the slide member 36. A similar configuration is present on the underside of the top piece 43, not visible in FIG. 14, to provide a passageway for receiving the slide member 38.

Positive stop grooves 51 are formed in the interior surface of the bottom wall 48 and top wall 44. These grooves cooperate with corresponding positive stop beads 52 formed on the interior ends of the first portion 36*a*, 38*a* of the slide members 36, 38 to limit the extend of travel of the slide members 36, 38 when moved to the open position. The beads 52 on slide member 36 interact with the grooves 51 on bottom wall 48 and the beads 52 on slide member 38 interact with the grooves 51 (not visible in FIG. 14) on the interior surface of the top wall 44, and thereby serve to retain the housing and the slide members 36, 38 in assembled relation. Ribs 53 formed on the sides of the first portions 36*a*, 38*a* of slide members 36, 38 cooperate with corresponding grooves 54 formed on the interior surfaces of the sides 45, 49 for retaining the slide members 36, 38 in the closed position, providing a positive "click" when the slide members are closed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A finger operable container comprising an assembly including a housing and a slide member received by the housing, at least one receptacle located in said housing for receiving a product, the receptacle having a bottom wall, and a pair of finger openings formed in the assembly through which two fingers of the same hand can be inserted, one of the finger openings being located in said slide member and the other finger opening being located in said housing, and the housing including a central access opening between the first and second finger openings providing access to the receptacle, the finger openings being configured and arranged to allow the finger movements of a single hand to move the assembly between a closed storage position in which said receptacle is covered by said slide member and an open position in which the receptacle is exposed to permit application of the product.

2. A container according to claim 1, wherein the slide member is transparent so that when the slide member is in the closed position, the color shade of the product in the receptacle can be seen.

3. A container according to claim 1, including a stop for temporarily maintaining the assembly in the closed position.

4. A container according to claim 3, including a stop for limiting the sliding movement of the slide member in the open position and thereby retaining the slide member in assembled relation with the housing.

5. A container according to claim 4, including a positive stop mechanism cooperating with each of said slide members for limiting the sliding movement of the slide members and retaining the slide members in assembled relation with the housing.

6. A finger operable container comprising an assembly including a housing and first and second slide members extending into said housing from opposite sides thereof, and at least one receptacle located in said housing for receiving a product, the receptacle having a bottom wall, and a pair of finger openings formed in the assembly through which two fingers of the same hand can be insert, said finger openings being located in said first and second slide members, and the housing including a central access opening between the first and second finger openings providing access to the receptacle, the finger openings being configured and arranged to allow the finger movements of a single hand to move the assembly between a closed storage position in which said receptacle is covered by said slide members and an open position in which the receptacle is exposed to permit application of the product.

7. A finger operable container comprising:

a housing having opposed top and bottom walls spaced apart from one another to form a hollow interior passageway terminating in an opening at a first end of the housing, a slide member having a first portion slidably received within the hollow interior passageway of the housing and an externally disposed second portion located adjacent the first end of the housing, a receptacle in said first portion of the slide member, the receptacle including a bottom wall for receiving the product thereon, a finger opening in said externally disposed second portion of the slide member through which a finger of the hand can be inserted for longitudinally sliding the slide member from a closed storage position in which said receptacle is covered by the housing to a open position in which the receptacle is exposed to permit application of the product and an additional finger opening in the container through which another finger of the same hand can be inserted so that the container can be moved between the closed to the open position by the finger movements of a single hand, wherein said finger openings are of a circular configuration and of substantially equal diameter, and including a circular mirror mounted on said housing between the finger openings.

8. A container according to claim 7, wherein the housing has a second end opposite said first end, and said hollow interior passageway terminates in a second opening at said second end, and including a second slide member extending into said second opening, said second slide member having a first portion slidably received within the hollow interior passageway of the housing and an externally disposed second portion located adjacent the second end of the housing.

9. A container according to claim 8, including a receptacle in said first portion of the second slide member for receiving a cream or paste type product, and wherein the second slide member is longitudinally slidable between a closed storage position in which said receptacle is within the housing to a open position in which the receptacle is exposed to permit application of the product.

10. A container according to claim 9, wherein said additional finger opening formed is formed in the externally disposed portion of the second slide member so that the both the first and second slide members can be moved between the closed to the open position by the finger movements of a single hand.

11. A finger operable container comprising:

a housing having opposed top and bottom walls spaced apart from one another to form a hollow interior passageway terminating in an opening at a first end of the housing, a central opening in the top wall of said housing, a receptacle beneath the central opening for receiving the product, a slide member having a first portion slidably received within the hollow interior passageway of the housing and positioned between the central opening and the receptacle for covering the receptacle, and an externally disposed second portion located adjacent the first end of the housing, a finger opening formed in said externally disposed second portion of the slide member through which a finger of the hand can be inserted for longitudinally sliding the slide member from a closed storage position in which said receptacle is covered by the slide member to a open position in which the receptacle is exposed to permit application of the product.

12. A container according to claim 11, wherein said first portion of the slide member is transparent so that when the slide member is in the closed position, the color shade of the product in the receptacle can be seen.

13. A container according to claim 11, including an additional finger opening in the housing through which another finger of the same hand can be inserted so that the container can be moved between the closed to the open position by the finger movements of a single hand.

14. A container according to claim 11, including a second slide member having a first portion slidably received within the hollow interior passageway of the housing and positioned between the central opening and the receptacle for covering the receptacle, and an externally disposed second portion located adjacent an end of the housing opposite said first end, a finger opening formed in said externally disposed second portion of the second slide member through which a second finger of the same hand can be inserted, and wherein said slide members are movable between a closed position protectively covering the receptacle and an open position in which the receptacle is uncovered.

* * * * *

UNITED STATES PATENT AND TRADEMARK OFFICE

CERTIFICATE OF CORRECTION

PATENT NO. : 7,306,103 B2
APPLICATION NO. : 10/931448
DATED : December 11, 2007
INVENTOR(S) : Dustin et al.

It is certified that error appears in the above-identified patent and that said Letters Patent is hereby corrected as shown below:

Column 6,

Line 10, "insert" should read --inserted--.

Signed and Sealed this

Sixth Day of May, 2008

JON W. DUDAS
*Director of the United States Patent and Trademark Office*